United States Patent [19]

Keithley, Jr.

[11] Patent Number: 4,940,009

[45] Date of Patent: Jul. 10, 1990

[54] SHAPE ADAPTABLE PROTECTIVE CUSHION DEVICE AND METHOD OF MAKING AND USING SAME

[76] Inventor: Howard W. Keithley, Jr., 9221 Willow Lane, Adelphi, Md. 20783

[21] Appl. No.: 98,321

[22] Filed: Sep. 18, 1987

Related U.S. Application Data

[63] Continuation-in-part of Ser. No. 717,793, Mar. 29, 1985, Pat. No. 4,694,774.

[51] Int. Cl.[5] ..... B63B 17/00

[52] U.S. Cl. ..... 114/343; 296/100; 114/361

[58] Field of Search ..... 296/100, 107, 98; 248/345.1, 359.1; 150/52 R, 52 K, 55; 135/88, 120; 114/343, 361, 364, 270; 403/234, 235, 237, 241; 206/586; 32/3; 160/382

[56] References Cited

U.S. PATENT DOCUMENTS

| | | | |
|---|---|---|---|
| 2,277,742 | 3/1942 | Crawford | 135/120 |
| 2,685,147 | 8/1954 | Burr | 248/345.1 |
| 3,051,524 | 8/1962 | Palmer | 296/100 |
| 3,314,717 | 4/1967 | Wild | 135/120 |
| 3,634,925 | 1/1972 | Van Loo | 248/345.1 |
| 4,694,774 | 9/1987 | Keithley, Jr.; | 114/364 |

*Primary Examiner*—Joseph F. Peters, Jr.
*Assistant Examiner*—Edwin L. Swinehart
*Attorney, Agent, or Firm*—John W. Huckert

[57] ABSTRACT

A flexible protective device formed with a base member of bendable material has a resilient pad on one surface, a plastic cushion on the opposite surface, and a plurality of projections from the base member. The base member of one embodiment is provided with a pivot hinge to allow adaptability to any angular configuration. Another embodiment uses a bendable spine with extensions therefrom. Further modifications include the use of hook and loop type affixing pads for mounting of the protective device on appropriate supporting frame structure of the device being protected. Further embodiments using double-faced adhesive pads and/or permanent magnets are included. In some instances, the coating on the base member projections may be omitted, and in other embodiments, the projections themselves may be omitted. The method of making and using the protective device are also part of the invention. A method of making protective pads wherein same are dipped in liquid latex prior to affixation of the cushioning pads, or, alternatively, after affixation of such pads, is disclosed. Also, mounting of the tarpaulin or dust shroud prior to installation of the respective protective pads at the points of stress is part of this invention. The forming of a plurality of interconnected protective pads, and forming same in desired configurations and shapes to follow the contour of the support body, is also included.

2 Claims, 7 Drawing Sheets

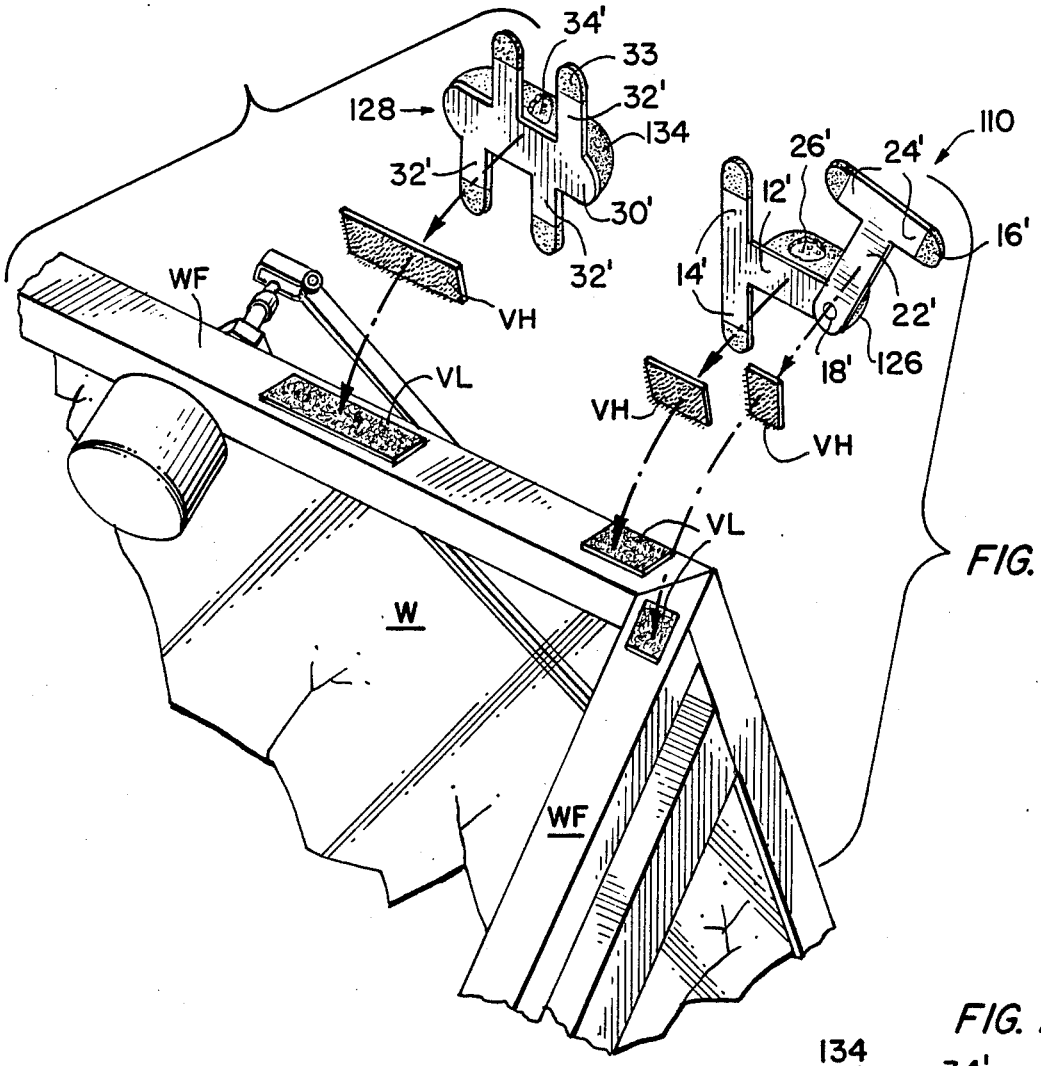
FIG. 19.
FIG. 21.
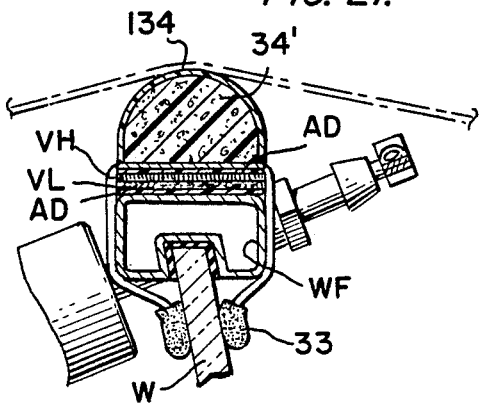
FIG. 20.
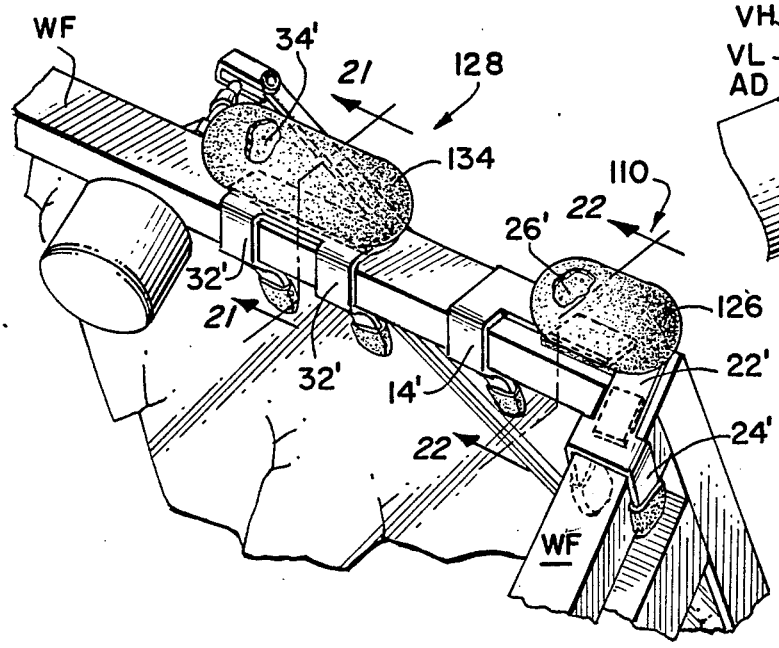
FIG. 22.
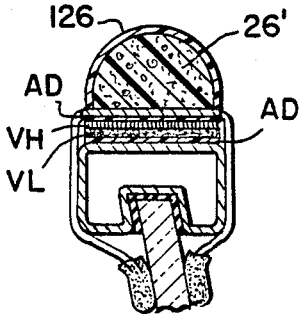

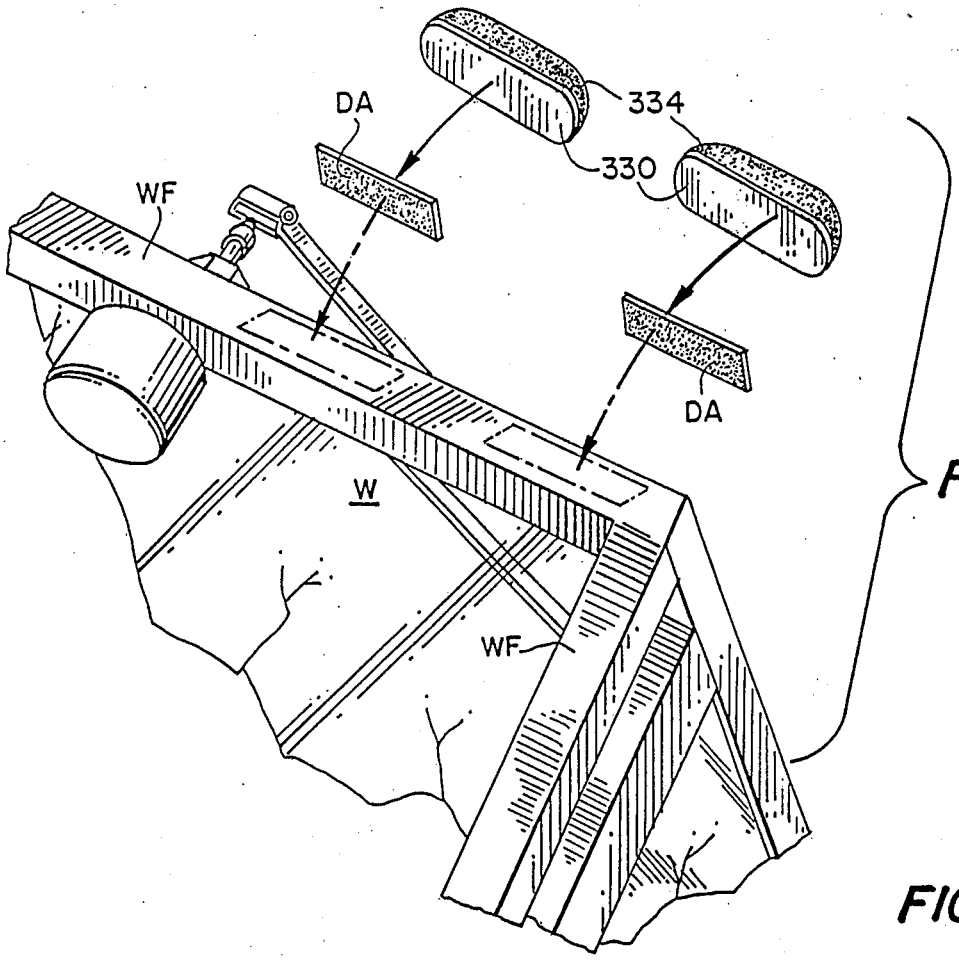
FIG. 27.
FIG. 28.
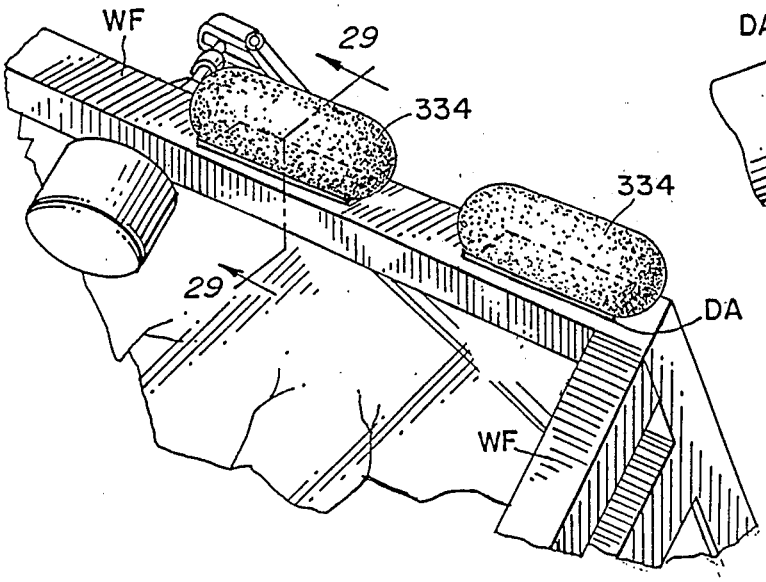
FIG. 29.
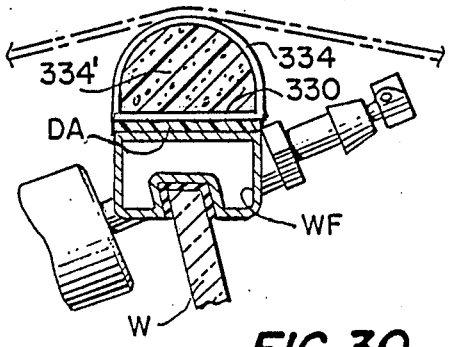
FIG. 30.
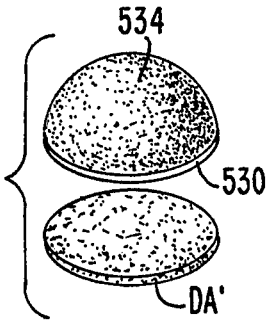

SHAPE ADAPTABLE PROTECTIVE CUSHION DEVICE AND METHOD OF MAKING AND USING SAME

The present application is a Continuation-in-Part of Application Ser. No. 717,793, filed March 29, 1985 now U.S. Pat. No. 4,694,774.

BACKGROUND OF THE INVENTION

1. Field of the Invention

This invention relates generally to devices for protecting covers or tarpaulins utilized for covering large articles such as boats, automobiles, trailers and the like, particularly when such covered articles are stored outside in exposure to sun, wind, snow or rain.

2. Description of the Prior Art

Devices for protective padding for covers or tarpaulins, particularly covers of fabric, are generally nonexistent. The closest known prior art patent which may be pertinent to the present invention is U. S. Pat. No. 3,634,925, granted on January 18, 1972 to William R. Van Loo, which shows a method of assembling a padded arm rest. In this patent, a channel member is placed in a mold and covered with plastic foam such as polyurethane, vinyl or other suitable material. Metal flanges of the channel are bent to secure the padded arm rest permanently to the chair structure. However, this known device does not offer the new and novel features of the present invention, in that only a very specific and limited use is provided thereby. The present invention is ideally suited to be temporarily, but securely, fastened to many differently shaped structures.

Additional patents which have been considered are Pat. Nos. 2,277,742 to Crawford, 3,192,542 to Mills, II, 3,973,720 to Schmid, and 4,143,653 to Wichman. However, none of these patented devices solve the problems described above and solved by the present invention.

For example, the device of Crawford for protecting canvas tents shows an elongated length of fabric which is adapted to overlie the top edge of a rafter which has attaching clips secured thereto and depending from the bottom face thereof, the clips having terminal portions configured to engage the bottom side edges of the rafter.

The Mills, II device is for a fabric cover for boats, which essentially comprises a flexible cover for the boat together with bendingly resilient fastener members secured to the body portion of the cover member at intervals along its edge and having portions thereof which extend across the outer surface of the boat's gunwale guard and resiliently contact the underside of the guard.

The Schmid patent is a protective cushioning pad having foldable sections for protecting the edges and corners of articles being packaged. The specific structure and arrangement of this device is substantially different from that of the present invention.

The Wichman patent shows a device for splintering broken extremities and comprises a flexible strip having individual perpendicular projections along one edge together with a cushioning element. Again, this structure is entirely different from that of the present invention.

SUMMARY OF THE INVENTION

An object of the present invention is to provide a simply constructed, shape adaptable, flexible protective pad for covers overlying large articles such as boats, automobiles, trailers, trucks, or the like.

Another object of the present invention is to provide an easily installed, semi-permanent, flexible protective pad which can be fabricated in quantity and in a cost-effective manner.

A further object of this invention is to provide a flexible protective pad which is simple to install, equally simple to remove, but can be secured in place to resist migration away from stress points.

Another further object is to provide a flexible protective pad which can be angularly adjusted as well as bent to conform to any compound corner configuration.

Another still further object of the present invention is to provide a protective pad device having a base member with pairs of projecting arms therefrom, the base member having a semi-rigid plastic cushioning element affixed thereto, and at least the extremities of the extending arms being coated with frictional cushion material.

A still further object of the present invention is to provide a protective pad having pairs of opposed arms extending from a central base, the opposed pairs of arms being directly opposed with respective pairs of arms parallel to the other pairs, or with the respective pairs being substantially at right angles to other pairs, or with the opposed arms of each pair being offset in relation to each other. These variations permit very specific components to be properly and adequately covered for protection of an external tarp or dust cover.

Another further object of the present invention is the provision for additional attaching structure to be provided with the various protective pad/base member devices, thus increasing the attaching and securing features thereof.

A still further object of the present invention is to provide a flexible protective pad which can be strategically located on or adjacent to irregularly shaped structures which put a stress upon tightly stretched covers and can cause damage such as ripping and tearing of such covers.

Another important object of the present invention is to provide a flexible protective pad which will present soft, rounded contours to fabric covers, or tarpaulins, or dust covers, which may shrink from the effects of rain, wind and drying sun and therefore rip or tear at certain points of stress.

Another further object of the present invention is to provide a series of protective pad structures which are interconnected with a flexible spine, wherein the spine may be severed between adjacent protective pad structures to create either individual protective pad devices, or a series of such pad devices may be retained in a string for use as a combined unit.

A further object is to provide a method of making a string of protective pad structures wherein base members connected together with a bendable spine can be formed or stamped from a continuous length of material and then dipped in liquid prior to attachment of cushioning pads to the spaced base portions, or in another modification, the cushioning pads are affixed to the spaced base portions and then the overall structure dipped.

A still further object is to provide individual protective pads having various structures for attachment of same to a smooth surface, for example, an auto body, wherein double-faced adhesive pads, or permanent magnet structures, are utilized with each protective pad structure.

The present invention offers many very important and desirable advantages and benefits over the known prior art. A plurality of protective pad devices of the present invention can be manufactured in a string of multiple units, and then after manufacture, an appropriate number of units, and/or groups of units, can be selected and detached from the main roll or supply thereof. The basic structure of each protective pad is a central base together with projecting arms extending therefrom. The projecting arms can be directly opposed, or can be opposed but in staggered relationship, or the pairs of opposed arms can be parallel to the other pairs, or the various pairs can be at angles relative to each other up to right angle or 90° configurations. The base can be bendable by use of suitable material for the base, or the base may be provided with a hinge portion for maximum bendability and shape forming ability thereof.

Preferably, each base member is provided with a semi-rigid mass of cushion material such as urethane foam, sheet foam, resin material having open or closed cells, hard rubber, synthetic rubber, or any other type material which is semi-resilient and yet rather firm and hard. At least the end extremities of the projecting arms should be coated or covered with semi-resilient and fairly high friction retention material, the purpose of this being to provide increased friction at the tips of the bendable projecting arms. Also, in many cases it is highly desirable to provide the entire undersurface, or surface opposite to the mass of semi-rigid cushioning material, with this semi-resilient friction material. For example, when applying one of the elongated protective pads to a boat cleat, the embodiment of this invention having offset opposed projecting arms and completely covered with semi-resilient cushion/friction material on the undersurface opposite the mass cushion block allows a very well fitted attachment of the overall device to the boat cleat.

It has also been discovered by the inventor of the present invention that in some applications it is highly desirable to provide additional attaching structure for the various protective pad/base member combinations. This is for application to boat frame portions where there is a tendency for the devices to possibly move therealong, even though the projecting arms have been deformed and bent around the appropriate frame structure.

Of course, with the multiple pad embodiment, a plurality of interconnected protective pads are applied as a combination unit to the desired support element and the plurality of projections formed around the element to firmly affix the series of pads thereto. In the case of protective pads of individual construction which may be used with automobiles, motorcycles and the like, Velcro pads, double-faced adhesive pads and/or permanent magnet structures may be utilized for holding each pad in desired position on the support element.

Also, the protective pad elements may be formed in configurations of insects, marine life, or the like. Shapes such as turtles, clams, crabs, spiders, lady bugs, etc. are all envisioned for lending variety to the protective pad structures of the present invention. In fact, with such embellishments, including colorful molding or painting thereof, these devices may even be used as entertainment devices and/or toys for children.

Another important feature of the present invention is in forming the base elements either singly or interconnected with interlinking spines, and then dipping same in suitable material such as liquid latex to completely cover the formed structural base elements. This dipping may take place prior to affixation and attachment of the cushion pads to the respective base portions, or the pads may be affixed to the base portions and then the overall structures dipped so that the coating is simultaneously applied not only to the body element, with or without projecting arms, but also to the cushion pads supported by the respective base elements.

It should be emphasized that the purpose of the protective pads of the present invention is for providing adaptability of the devices to many areas of a boat, and/or other units such as automobiles or trucks, which needs to be covered and protected by a tarpaulin or the like. Tarpaulins and specifically configured covers for boats, trailers, etc. are very expensive. Even the most common sizes and relatively small tarpaulins today are expensive. Thus, it is highly desirable for anyone using such covers to protect same against ripping or tearing in use. By using the protective pads of the present invention, this can be easily achieved.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 19 is an exploded perspective view of the protective devices of the present invention, together with additional attaching structure.

FIG. 20 is a perspective view showing the protective pads of FIG. 19 mounted and attached to the upper frame rail of a boat windshield.

FIG. 21 is a view, partly in cross-section, taken generally along line 21—21 of FIG. 20.

FIG. 22 is a view, partly in cross-section, taken generally along line 22—22 of FIG. 20.

FIG. 27 is an exploded perspective view similar to FIG. 19 depicting a protective pad with double-faced adhesive attaching structure.

FIG. 28 is an assembled perspective view of the structure of FIG. 27 as assembled.

FIG. 29 is a cross-sectional view taken generally along line 29—29 of FIG. 28 showing how the double-faced adhesive fixing structure securely attaches a protective pad to the windshield frame.

FIG. 30 is a perspective view of a simple semi-hemispherical protective pad utilizing a double-faced adhesive disc for affixing same to a support element.

DETAILED DESCRIPTION OF THE PREFERRED EMBODIMENTS

Figure 1:
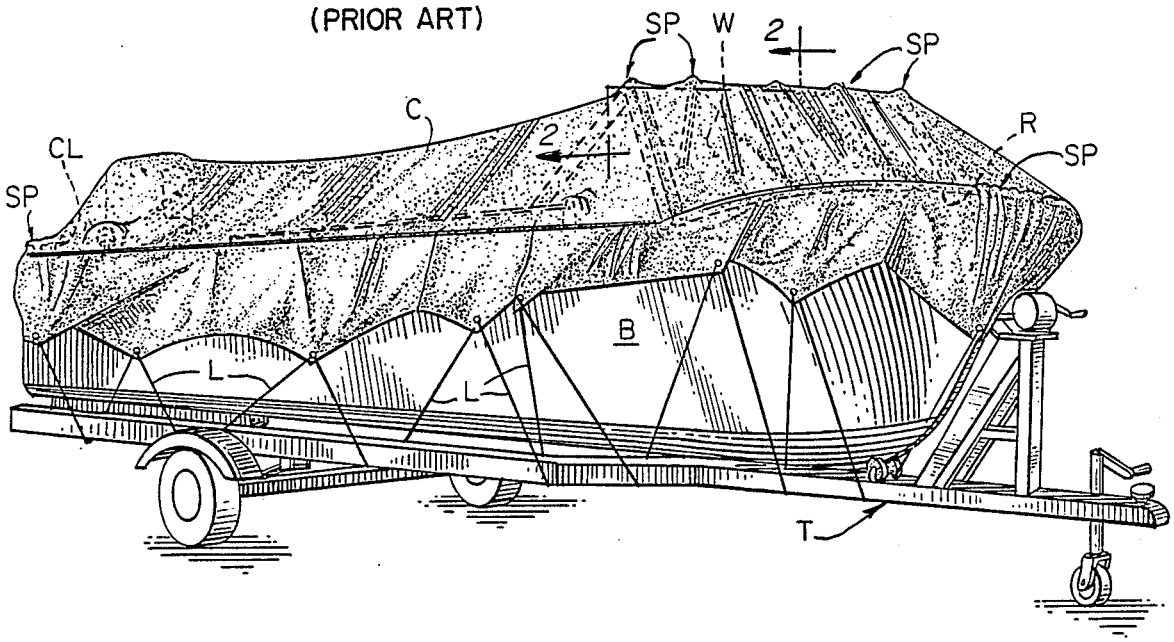
FIG. 1. (PRIOR ART)
FIG. 1 is a perspective view of a small craft protected by a storage cover.
Figure 2:
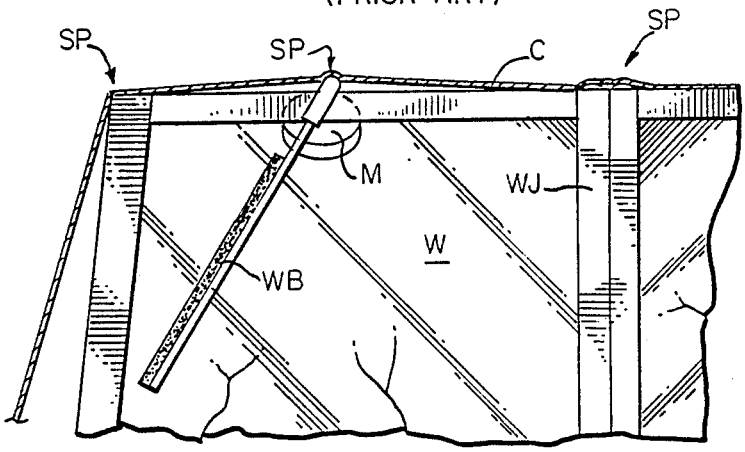
FIG. 2. (PRIOR ART)
FIG. 2 is a fragmentary sectional view taken along line 2—2 of FIG. 1.

In the perspective view of FIG. 1, there is shown a small craft B cradled upon a trailer T snugly shrouded by a cover C which is securely fastened in place by ropes or lines L in accordance with present practice. Multiple stress points SP are indicated, particularly with respect to the windshield W, stern cleat CL and bow rail R, all of which are potential damage areas to cover C, as best shown in FIG. 2. FIG. 2 shows the windshield joint WJ having at the top edge thereof a stress point SP and a windshield blade WB connected to wiper motor M having another stress point SP at the top connection thereof, and, of course, at the edge of the windshield, another very pronounced stress point is present.

The flexible protective pad 10 of FIG. 3 which is adapted to conform to boat structure, as will be later described, is fabricated of a flexible base 12 having lateral, bendable arms 14 with padded tips 16 connected by means of a rivet 18 or other suitable means to a base extension 22, provided with lateral bendable arms 24 also having soft padded tips 16.

Figure 5:
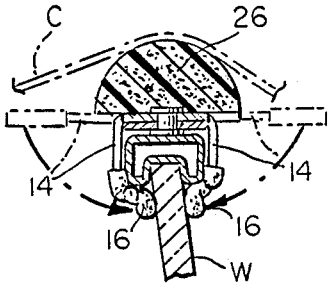
FIG. 5 is a transverse cross-sectional view, as taken along line 5—5 of FIG. 4, and illustrates the flexible protective pad securely crimped in place along a top portion of a boat's windshield.

Adhesively or otherwise secured to base 12 is a resilient cushion 26 formed of polyurethane foam, rubber or the like. As shown in FIG. 5, the flexible arms 14 and 24 have been securely crimped in place along the top edge of a windshield W, for example, to offer a softly contoured shape to the overlying cover C.

Figure 7:
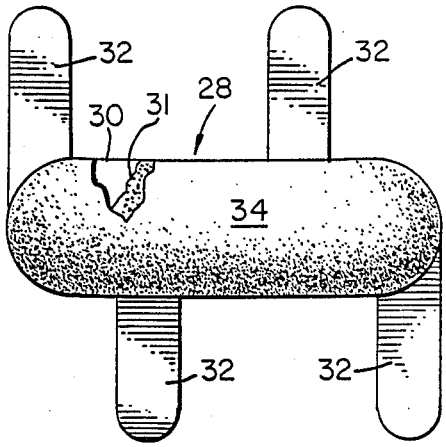
FIG. 7 is a top plan view of a second form of the present invention.

FIG. 7 is illustrative of a one-piece linear flexible pad 28 of the present invention, wherein flexible base 30 having lateral offset arms 32 has a resilient cushion 34 affixed thereto by a layer of adhesive 31.

Figure 3:
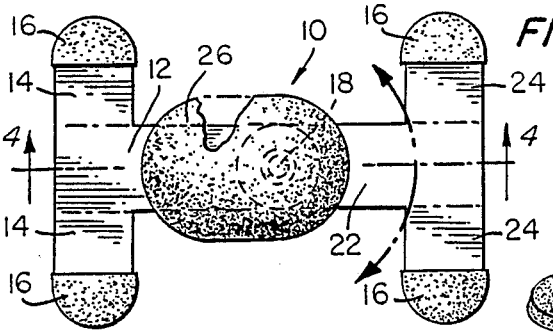
FIG. 3 is a plan view of a first form of the invention comprising an articulated flexible protective pad.
Figure 6:
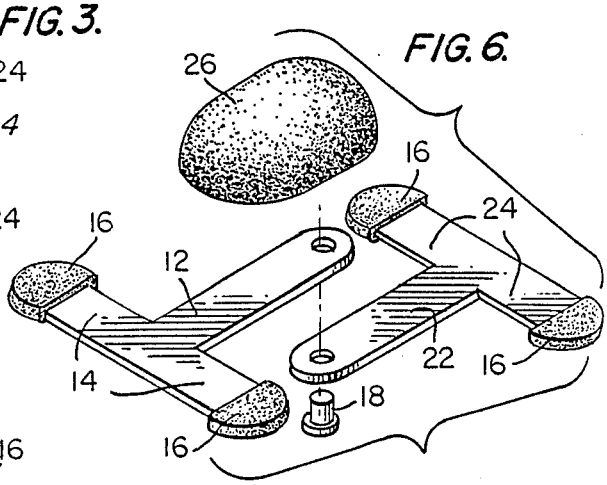
FIG. 6 is an exploded perspective view of the flexible protective pad of FIG. 3.
Figure 8:
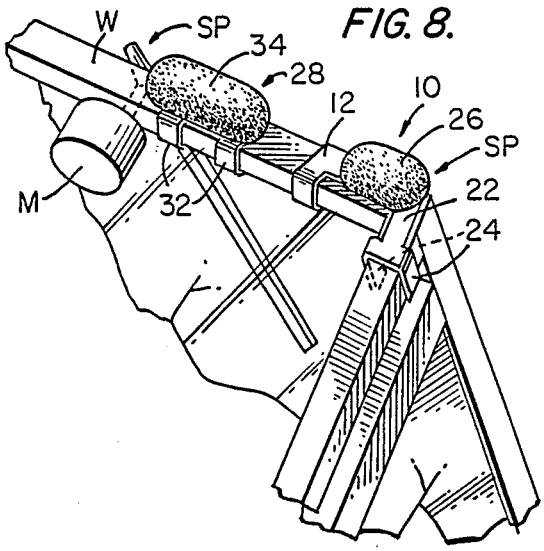
FIG. 8 is a fragmentary perspective view of a boat windshield with both types of flexible protective pads mounted thereon.

FIG. 8 shows the pivoted pad 10 of FIG. 3 crimped in place along the top corner of a boat windshield W with the base extension 22 pivoted into a compound 90° angle and with the second pad 28 securely crimped alongside thereof to offer padding to both the stress points SP as shown.

Figure 10:
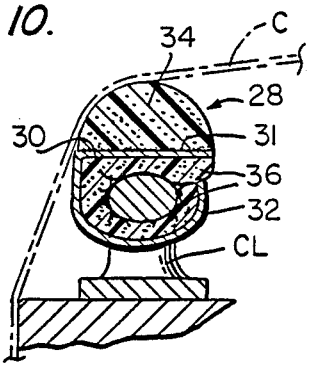
FIG. 10 is a transverse cross-sectional view taken along line 10—10 of FIG. 9.
Figure 9:
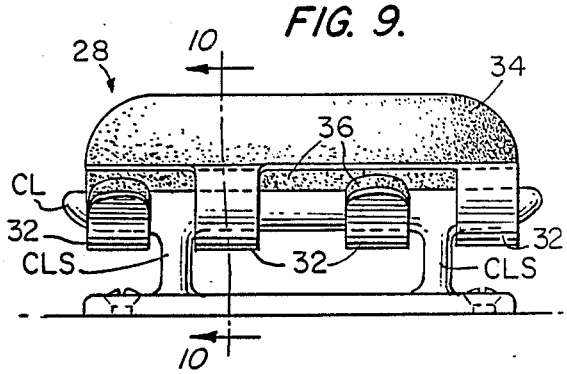
FIG. 9 is a side elevation of the flexible protective pad of FIG. 7 crimped upon a cleat.

In FIG. 9, the linear flexible protective pad 28 of FIG. 7 is shown with offset arms 32 having urethane foam 36 applied along the bottom surface thereof for securely embracing the surfaces of a cleat CL to present resilient pad 34 to cover C in a softly contoured angle, as shown in FIG. 10.

As is seen in FIG. 10, the semi-resilient and friction retention material 36 completely surrounds the cleat and thus provides an extremely secure attachment of the protective pad device 28 to the cleat. As seen in FIG. 9, because of the arms 32 which are opposed to each other being offset, each respective pair can interengage around a cleat closely adjacent to the cleat supports CLS. Thus, the protective pad cannot slide either forwardly or rearwardly off of the cleat, which is the problem with so many prior protective type devices.

Figure 11:
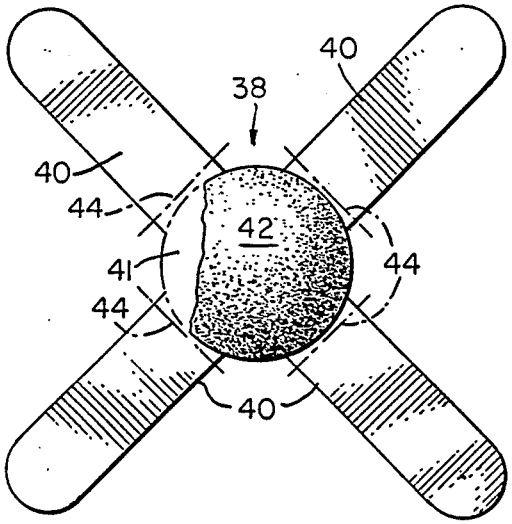
FIG. 11 is a top plan view of another form of the present invention.
Figure 12:
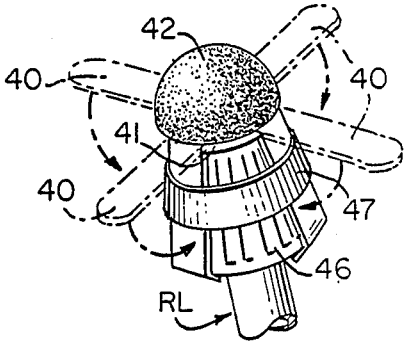
FIG. 12 is a perspective view of the structure of FIG. 11 crimped onto a boat's running light.

FIG. 11 illustrates a flexible protective pad 38 on a disc 41 having bendable "X" shaped arms 40. The arms 40 are bent along lines 44, as shown in FIG. 12, for example, to surround the lens 46 of a running light RL, and are secured to each other by tape 47. It is obvious that the arms 40 can be bent to conform to various diameters as needed, and need not be taped together at all.

In this embodiment of FIGS. 11 and 12, the friction retention, semi-resilient material, such as 36 of the previous embodiment, has been omitted. It has been omitted from the showings primarily for the purpose of showing that in some type of applications the protective pad will function adequately without the semi-resilient friction retention material.

Figure 13:
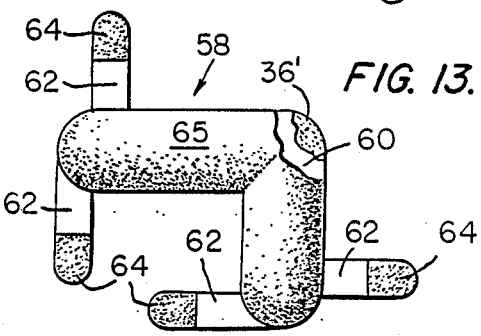
FIG. 13 is a top plan view of a fourth form of the present invention particularly for padding outside and inside corner configurations.

FIG. 13 discloses an "L" shaped protective pad 58 which is particularly adapted to outside or inside corners as required. Base 60 is provided with arms 62, which are offset with respect to one another. Arms 62 are also padded at their extremities with neoprene rubber 64, or other similar resilient material having a high frictional coefficient. A resilient L-shaped cushion 65 is formed on the base member 60. Thus modification is particularly effective in padding sharp corners of windshields or other 90° configurations. As seen in the broken away section, a semi-resilient friction retention layer 36' has been applied to the undersurface of this embodiment. Again, in some versions this can be eliminated. While 90 ° is a very usable configuration, 30 ° or 60° forms (or other angles) can be provided if desired.

Figure 14:
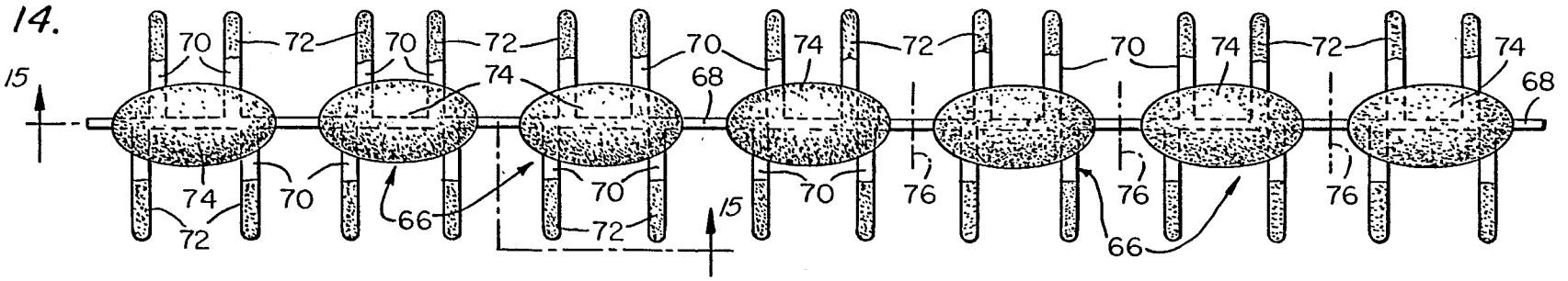
FIG. 14 is a top plan view depicting a method of forming multiple units of the present invention.
Figure 16:
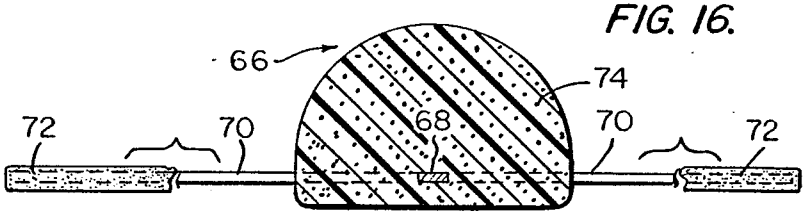
FIG. 16 is an enlarged transverse cross-sectional view taken along line 16—16 of FIG. 15.
Figure 15:
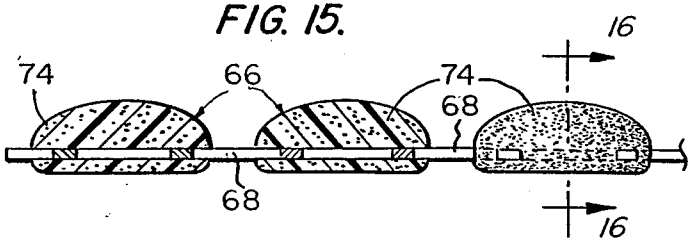
FIG. 15 is a vertical sectional view taken along line 15—15 of FIG. 14.

FIG. 14 is illustrative of a method of multiple fabrication of the flexible protective pads 66 of the present invention. In this figure, a fifth embodiment of the invention is depicted wherein the base of each pad device is of bendable material and the bendable arms 70 which project from opposing sides of the base are staggered in relationship to each other. Notice the difference between this staggering and the staggering of the FIG. 7 second embodiment. During manufacture of this embodiment, the entire length of the spine can be stamped from a roll of sheet metal with simultaneous forming of the spine together with the projecting arms. After forming of the overall base structure, then the appropriate cushioning materials can be applied. As shown, a continuous spine 68 is formed with integral bendable arms 70 having rubber or neoprene tips 72 and resilient pads 74 at spaced intervals thereon. The completed assembly of flexible protective pads 66 can be left intact, as manufactured, or individual pads 66 can be cut apart along cut lines 76.

Figure 18:
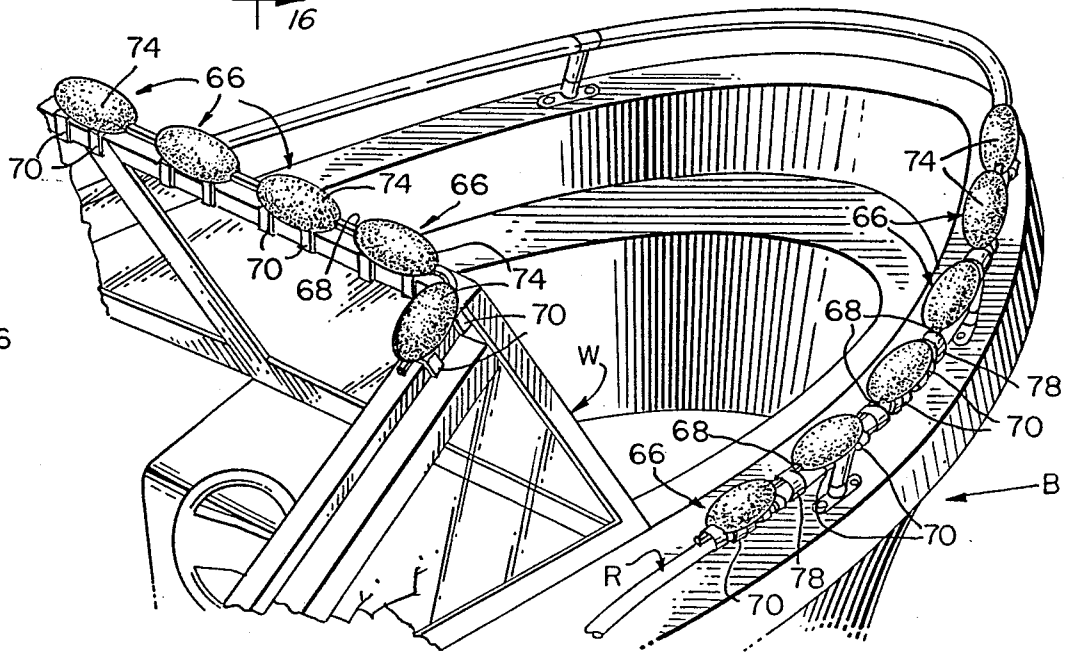
FIG. 18 is a fragmentary perspective view of a boat bow rail and windshield provided with the flexible pads of FIG. 15.
Figure 17:
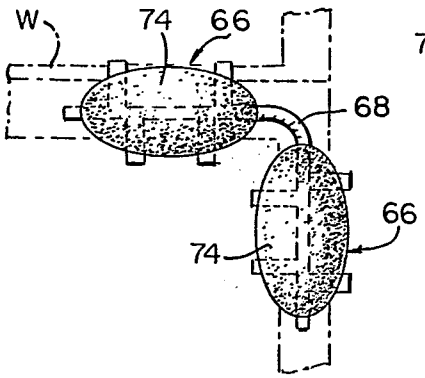
FIG. 17 is a top plan view of the corner portion of a boat windshield padded by two components of the structure of FIG. 14.

As best shown in FIGS. 17 and 18, multiples of two, five and six flexible protective pads are shown mounted along windshield W, and bow rail R. Tape 78 may also be utilized, as shown in FIG. 18, to secure spine 68 tightly to bow rail R because of the small size of the latter.

Throughout the several forms of the invention, it should be understood that the bendable arms can be trimmed or shortened, or, if necessary, eliminated by merely utilizing metal cutting shears.

Resin materials and/or foam materials which may be used for the padding material of this invention are as follows:

(1) Synthetic resin foams of thermoplastic or thermoset, open or closed cells material. These foams can be self-foaming, such as polyurethane or polystyrene resin, or they may be synthetic resins which contain a foaming agent such as carbonates or peroxides.

(2) There also can be used natural resins, such as rubber latex, which can be foamed by foaming agents.

The base members, and/or interconnecting spines, preferably are formed of material which has a shaped form retention characteristic. Metals, such as galvanized steel, tin, stainless steel, aluminum and copper are such materials. Also, many different plastics can be used. Even laminated products such as impregnated or treated cardboard and the like could be used.

Figure 4:
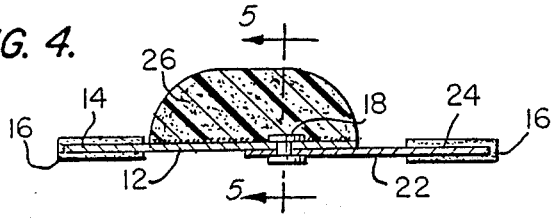
FIG. 4 is a vertical longitudinal sectional view taken along line 4—4 of FIG. 3.

FIGS. 19–22 show several of the protective pad embodiments together with additional attaching and holding structure. Oftentimes, when the protective pad devices of the present invention are mounted upon smooth frame rails, such as the upper frame rail of the windshield of a boat, there may be a tendency for the device to creep along the rail, even though the projecting arms have been firmly bent therearound. Therefore, in order to prevent such undesired movement, additional securing structure may be provided for the protective pads. As shown in FIGS. 19 and 20, the pad device 110, which is the embodiment of FIGS. 3–5, is shown with the additional attaching structure. The various elements of the protective pad corresponding to the FIGS. 3–6 drawings have the same reference numerals with a prime added thereafter. Pads VH provided with a plurality of hooks thereon are affixed by adhesive AD to the respective base members 12' and 22' to complement the hooked pads VH, similar pads VL having loop structure thereon are affixed by adhesive AD to the windshield rail frame WF. The cross-sectional view of FIG. 22 shows the adhesive layers AD for attaching the respective pads VH and VL.

It should also be noted that in this modified embodiment the protective pad 26' has been coated with an impervious outer skin 126. This may or may not be desirable with any or all of the embodiments disclosed.

The pad device 128 of FIGS. 19 and 20 is similar to the embodiment already disclosed in FIGS. 7–10. It should also be noted that the view of FIG. 20 is very similar to that of FIG. 8. Again, for the pad device 128, reference numerals corresponding to similar elements of the embodiment of FIGS. 7–10 utilize the same numbers with a prime added thereto. Again, hook pads VH are affixed by suitable adhesive AD to the base member 30' of the 128 pad and loop pads VL are affixed by similar adhesive to the windshield frame rail WF. The cross-section of FIG. 21 shows the pad structure 128 cut through the middle. Again, an outer protective covering 134 has been provided for this modification of the FIGS. 7–10 embodiment.

Hook pads and loop pads are known in many environments; however, the use of same with the protective pads of the present invention offers an additional improvement over known prior art devices. Such hook and loop structure commonly is sold under the trade name of VELCRO; however, the use of modified structures along this same line is envisioned.

Figure 23:
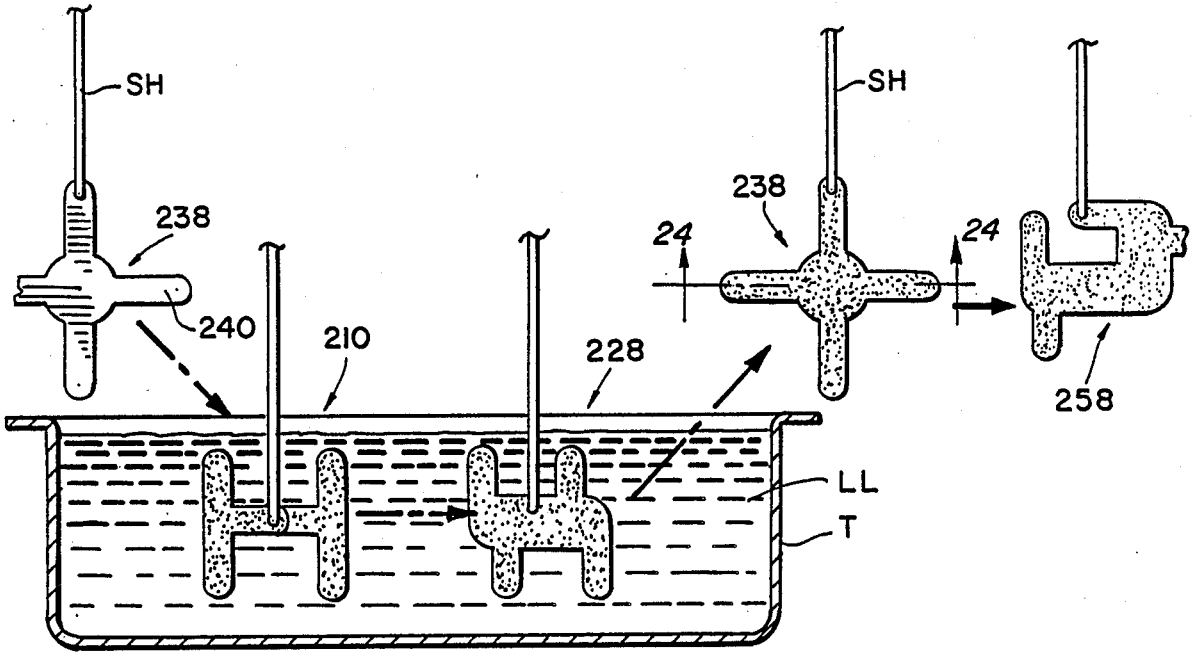
FIG. 23 depicts schematically a method of dipping entire base members in liquid latex or similar coating material.

Looking at FIGS. 23–26, various additional methods of making and coating embodiments of the present invention will now be described. In FIG. 23, a plurality of different embodiments 210, 228, 238 and 258 are shown being movably carried by support hangers SH along a conveyor line for dipping in a tank T containing a suitable liquid coating medium, such as liquid latex LL. While liquid latex has been found quite suitable for this invention, of course other similar semi-resilient coating materials may be utilized. This coating not only provides the friction surface for the tip ends of the projecting arms of the various embodiments, but also covers any sharp edges and provides protection against accidental cutting of a user of the device. In FIG. 23, the dipping takes place with the respective base elements together with projecting arms or projections extending therefrom as depicted, and prior to affixing or attachment of the respective cushion pads to the respective base members.

Figure 24:
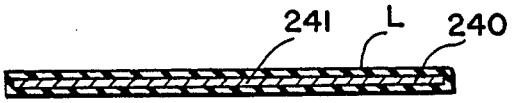
FIG. 24 is an enlarged cross-sectional view taken generally along line 24—24 of FIG. 23 depicting the entire encapsulation of the base member.
Figure 26:
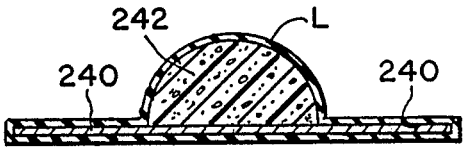
FIG. 26 is an enlarged cross-sectional view taken generally along line 26—26 of FIG. 25, showing the base member, together with cushion pad affixed thereon, encapsulated as a combination unit.

FIG. 24 shows how the entire base element with projections is covered with the latex LL after the dipping has taken place.

In FIG. 25 support hangers SH again carry the individual pad structures along a conveyor line and arrange for dipping of same into a tank T having liquid latex LL therein. However, in this embodiment, the cushion pads, for example pad 242 with element 238', has been affixed to the base element prior to the dipping taking place. A similar protective pad 238' after exiting from the tank has the affixed pad 242 completely encapsulated as shown at 242C, and as best seen in the cross-sectional view of FIG. 26. Structure 210' has a protective pad 226 affixed thereon for receiving the protective coating, as does structure 228' with pad 234 thereon. A coated protective pad 265C is shown as the right-most device 258' in FIG. 25.

Figure 25:
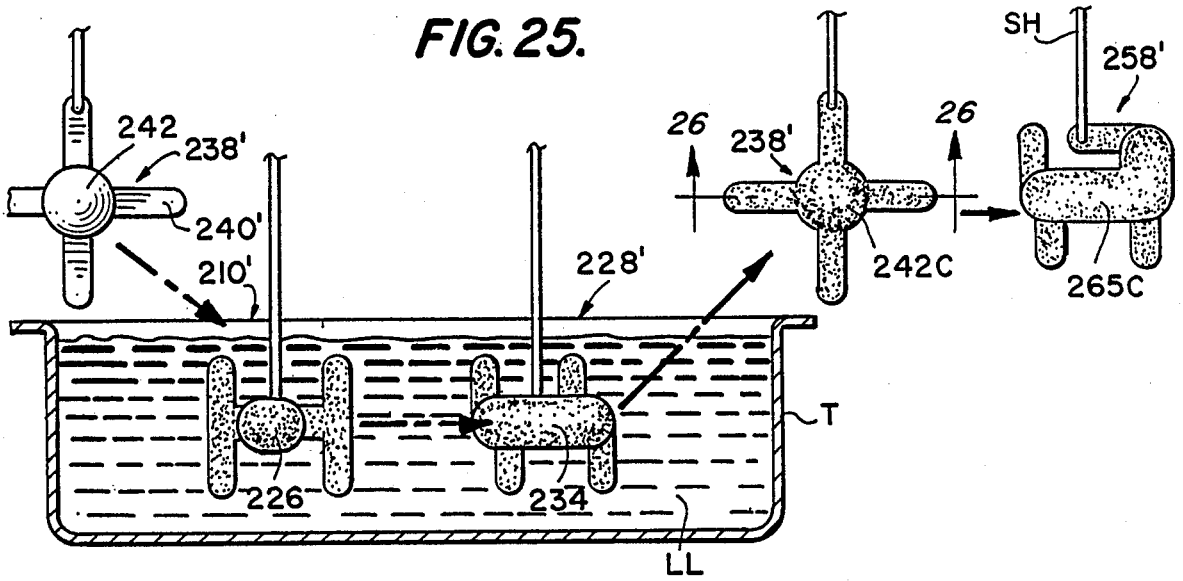
FIG. 25 is a view similar to FIG. 23 illustrating a method of dipping the entire assembly, complete with cushion pad, in a coating medium.

Of course, if the formed serial embodiments of FIGS. 14–18 are being made, they can be suitably dipped in liquid latex using the same method just explained for FIGS. 23 and 25. Coating of the pad structures as interconnected with the bendable spine can occur prior to affixing of the respective cushion pads, or thereafter for complete encapsulation, as already described with reference to FIGS. 25 and 26.

Looking at FIGS. 27–29, another protective pad device of the present invention will be described. This embodiment, which is similar to that of FIG. 19, eliminates the projections from the base member and utilizes a double adhesive pad DA for affixing the base element 330 with cushion pad 334 thereon to the respective support elements of the boat, or the like. Preferably, the double adhesive pad DA is of rubber or similar material having very sticky adhesive on both sides thereof. One side of the adhesive pad can be firmly affixed to the base element 330 and the other side firmly affixed to a support element on which it is desired to mount the protective pad. This can be boat, motorcycle, bicycle or automobile structure, and the like.

Looking at FIG. 29, a cross-sectional view of how the coated base element 330 and cushion pad 334' are semi-permanently affixed to the windshield frame WF of a boat is shown.

In FIG. 30, a modified protective pad 534 is shown. This pad is hemispherical in shape and is provided with a base element 530 for affixation to one side of a double adhesive pad DA. The use and mounting of this embodiment is similar to that described for FIGS. 27–29.

Figure 31:
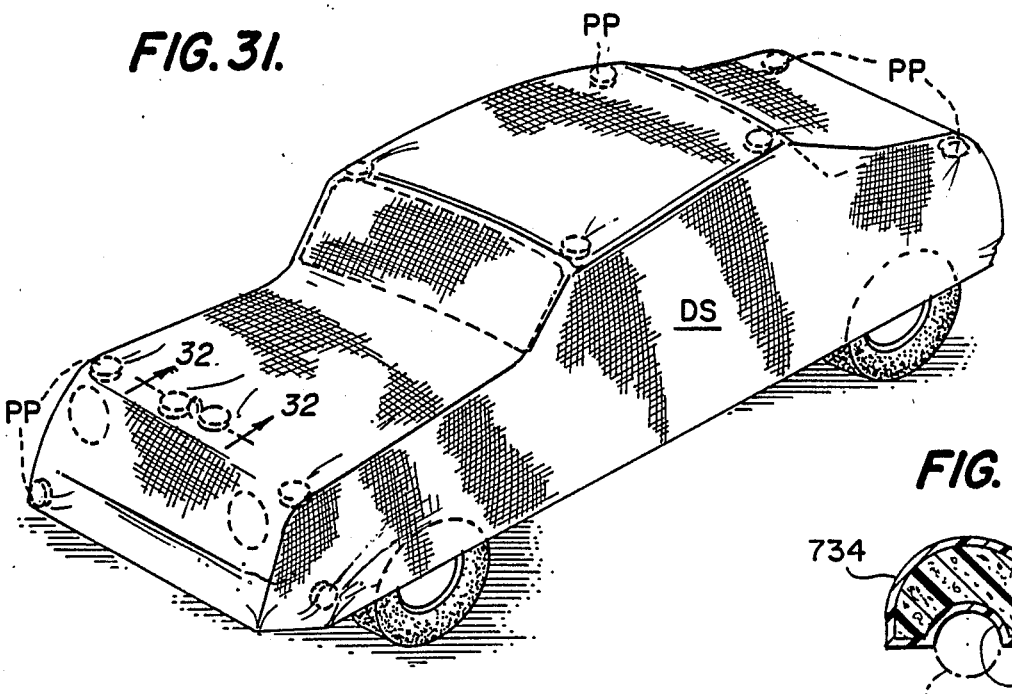
FIG. 31 shows in perspective an automobile covered with a protective dust shroud and provided with a plurality of.protective pads such as illustrated in FIG. 30.
Figure 32:
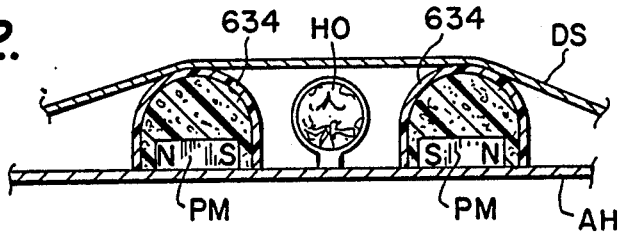
FIG. 32 is a fragmentary cross-sectional view taken along line 32—32 of FIG. 31 showing how two protective pad devices of the present invention raise the plane of the dust shroud above the automobile hood decorative ornament. This embodiment also utilizes permanent magnets for affixing the protective pads to the automobile body.

FIGS. 31 and 32 show how a protective pad similar to that of FIG. 30 can be utilized for protecting an automobile dust shroud DS. Suitable protective pads PP are applied to the vehicle at desired points thereon for protecting the dust shroud DS from stress, ripping and tearing. As shown in FIG. 32, a pair of protective pads can be spaced on either side of the hood ornament HO to raise the shroud DS thereabove. Also, in FIG. 32 another embodiment 634 of the pads is depicted. This embodiment utilizes permanent magnets PM for affixing the respective pads to the automobile hood AH, rather than using Velcro or adhesive pads as previously described.

Figure 33:
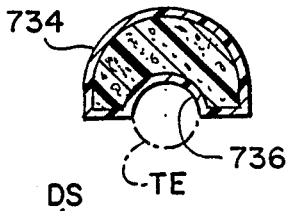
FIG. 33 is a cross-sectional view of a modified protective pad device formed with a semi-arcuate groove in the bottom thereof to accommodate circular or tubular structural members.

In the embodiment depicted in FIG. 33, a protective pad 734 is provided with a circular recess 736, or an elongated groove which in cross-section is similar to 736, for receiving a spherical or tubular element TE therein. Suitable adhesive or Velcro affixing structures (not shown) may be utilized with this embodiment.

The inventor has found through actual tests and experiments that for maximum utility and ease of installation of the protective pad devices of the present invention, the following method should be utilized. First, the cover, top or dust shroud is applied to the boat or other vehicle, and then by visual inspection, points of stress, corner wear points, and other cover wear areas, are determined. After this, the cover or top is then lifted far enough so that appropriate protective pads may be applied where needed. The pads are affixed with the projections extending from the respective base elements, or the Velcro, double adhesive pads, or permanent magnet affixation structures are employed to semi-permanently affix the respective pads in their desired positions. Then, the cover and/or top can be attached securely to the boat or other vehicle being covered by suitable ropes, "bungie" stretch cords, or other suitable means. The reason for the foregoing procedure and method of installation is that oftentimes if the pads are clamped or affixed in position prior to the cover application, since the covers generally are quite heavy, when same are pulled or tugged, the cover or top itself will tend to dislodge the protective pads from their desired positions. However, when the recommended method set forth above is utilized, this does not occur.

After the cover is removed prior to boat or vehicle use, the protective pads can be gently pried away from the support structure, and in the case of the formed projections or arms, these may be left in the still partially bent condition and the pads stored for use the following storage season.

Figure 34:
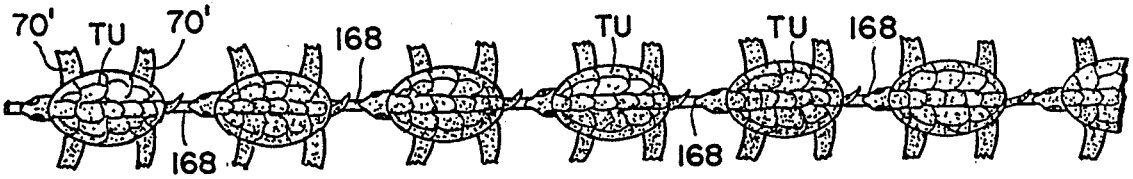
FIGS. 34–36 illustrate the serial fabrication of protective pad devices formed in stylized natural configurations, such as various marine life and insect configurations.
Figure 35:
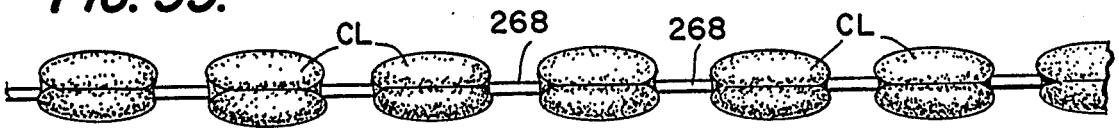
Figure 36:
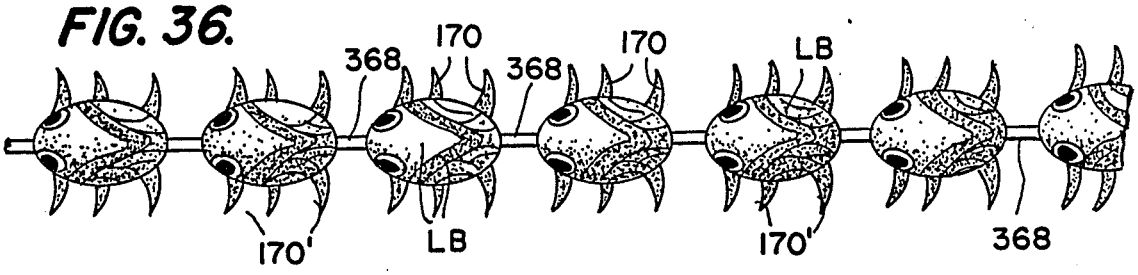

As shown in FIGS. 34–36, the shape and appearance of the protective pads can be substantially enhanced by providing them in the shape of desired configurations, such as various species of marine life, insect life, animal life and the like, but in addition, color combinations can be utilized to substantially increase the appeal of the these devices. For instance, blaze orange or yellow, together with appropriate eyes, stripes and other decorations, could be utilized. Of course, some of these colors could be provided or added during the dipping operation as previously described.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective device for covers comprising:

a base member;

said member being made of material which is bendable and has a shaped form retention characteristic;

retaining means which can be attached to an element to fasten the device thereto including lateral projections integral with and made of the same material as said base member for retaining the shape form after being bent about said element;

cushioning means affixed to said base member;

additional retention means affixed to said base member for preventing longitudinal movement thereof after being mounted on appropriate support structure;

said additional retention means including at least one pad having a plurality of hooks, and a complementary pad of loops for permanent affixation on support structure.

2. Protective apparatus for use with structures to be covered with a protective tarpaulin or the like comprising:

a base member;

said base member being bendable into a shaped form and of such material as to tend to retain such shape after being formed thereinto;

cushioning means affixed to one side of said base member;

retention means affixed to the opposite side of said base member;

said retention means including structure having a plurality of hooks extending therefrom; and a complementary pad having a plurality of hoops extending therefrom for permanent mounting to appropriate support structure.

* * * * *